United States Patent [19]

Dean

[11] 4,285,152

[45] Aug. 25, 1981

[54] SEMI-AUTOMATIC DOUBLE ACTION REVOLVER

[76] Inventor: Joe O. Dean, 5841 NE. 22nd Ave., Fort Lauderdale, Fla. 33308

[21] Appl. No.: 23,317

[22] Filed: Mar. 23, 1979

[51] Int. Cl.[3] ..... F41C 1/00

[52] U.S. Cl. ..... 42/59; 42/62; 42/65; 42/66

[58] Field of Search ..... 42/59, 62, 65, 66; 89/155, 157, 161

[56] References Cited

U.S. PATENT DOCUMENTS

| | | | |
|---|---|---|---|
| 380,361 | 4/1888 | Sprague | 42/62 |
| 1,972,763 | 9/1934 | Dutton | 42/59 |
| 2,835,171 | 5/1958 | Lyon | 42/59 |
| 3,027,673 | 4/1962 | Oliver | 42/65 |
| 3,045,556 | 7/1962 | Westmoreland | 89/155 |
| 3,628,278 | 12/1971 | Ruger | 42/62 |
| 4,128,957 | 12/1978 | Lee | 42/66 |

FOREIGN PATENT DOCUMENTS

| | | | |
|---|---|---|---|
| 1128584 | 8/1956 | France | 42/59 |

*Primary Examiner*—Charles T. Jordan
*Attorney, Agent, or Firm*—Brady, O'Boyle & Gates

[57] ABSTRACT

A semi-automatic double action revolver having an axially slidable and rotatable barrel aligned with a lower chamber of a top pivotal swing-out cylinder. The trigger mechanism includes a safety rod to prevent the opening of the cylinder while the hammer is cocked, or not in the rest position, and a transfer bar is provided between the hammer and the firing pin so that the firing pin can only be actuated when the trigger has been pulled all the way back, beyond the double action and single action hammer cock position.

8 Claims, 2 Drawing Figures

SEMI-AUTOMATIC DOUBLE ACTION REVOLVER

BACKGROUND OF THE INVENTION

Since the introduction of the Colt single action 0.45, the basic configuration and design of the service revolver has not been improved until the Colt semi-automatic pistol in 1911. As a result, large caliber service revolvers and semi-automatic pistols have become uncontrollable to the average shooter and controlled rapid fire is impossible to achieve with adequate accuracy. After considerable research and experimentation, the semi-automatic double action service revolver of the present invention has been devised to provide improved controllability, accuracy and safety.

The improved controllability and accuracy is provided by the revolver of the present invention by employing an axially slidable and rotatable barrel aligned with a lower chamber of a top pivotal swing-out cylinder. By this construction and arrangement, recoil, torque, and upward thrust or chuck is reduced by aligning the barrel with the axis of recoil whereby the line of sight or point of aim is retained for a subsequent shot.

The improved safety is provided by the revolver of the present invention by employing a safety rod to prevent the pivoting of the cylinder to the open position while the hammer is in the cocked position, and a transfer bar is employed between the hammer and firing pin so that the firing pin can only be actuated when the trigger has been pulled all the way back.

DESCRIPTION OF THE PREFERRED EMBODIMENT

Figure 1:
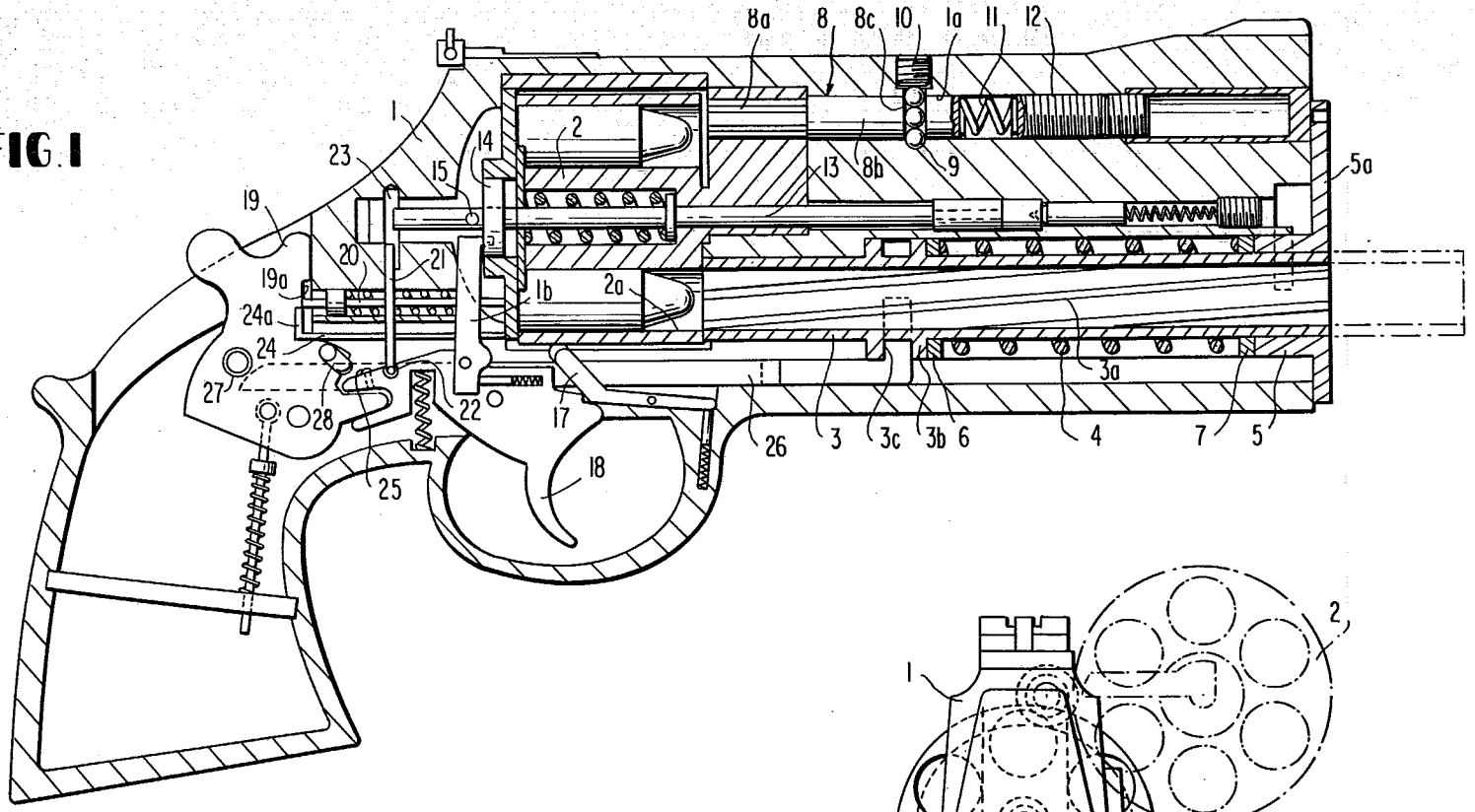
FIG. 1 is a sectional side elevational view of the revolver of the present invention.

Referring to the drawing and more particularly to FIG. 1 thereof, the revolver of the present invention comprises a frame 1 having a cylinder 2 rotatably mounted therein. The lower chamber 2a of the cylinder is aligned with an axially extending barrel 3 slidably mounted in the frame 1. The barrel 3 has a rifled bore 3a and extends coaxially within a compression spring 4 and a tubular portion 5 of a retaining plate 5a secured to the frame 1. The spring 4 is biased between axially spaced friction washers 6 and 7 which are supported on a shoulder 3b formed on the barrel 3 and the tubular portion 5, respectively.

By aligning the barrel 3 with the lower chamber 2a of the cylinder 2, the use of a top pivotal crane assembly is employed rather than the conventional bottom pivot swing out assembly. The crane assembly comprises a shaft 8 having one end 8a secured to the cylinder 2 and the other end 8b rotatably mounted in a bore 1a formed in the frame 1. The shaft 8 is provided with a groove 8c which forms an inner race for a plurality of ball bearings 9, the outer race of the bearings being provided by a groove formed in the wall of the bore 1a and a plug 10 threadably mounted in the frame. A torsion spring 11 is also mounted in the bore 1a and has one end connected to the end of the shaft 8 and the other end connected to a set screw 12 threadably mounted in the bore 1a. By this construction and arrangement, when the cylinder latch is released, the torsion spring 11 will cause the cylinder to pivot to the open position as shown in phantom in FIG. 2.

The revolver of the present invention also includes the conventional ejector rod 13, ratchet head 14, cylinder release latch pin-plunger assembly 15, ratchet head pawl 16, cylinder bolt 17, trigger 18, hammer 19 and firing pin 20, a detailed explanation of which is not deemed necessary since the function and operation of these components are well understood by those skilled in the art.

In addition to the above-noted conventional components, the revolver of the present invention is provided with a safety rod 21 having one end connected to the trigger as at 22 and the other end extending upwardly and slidably mounted in a recess 23 formed in the frame 1. While the rod 21 is in the position shown in FIG. 1, the cylinder latch pin 15 can be actuated to allow the cylinder to swing to the open position; however, if the hammer 19 is cocked, the rod 21 is caused to slide upwardly into the recess 23 to prevent the ejector rod 13 and associated cylinder 2 from swinging outwardly.

Another safety feature provided in the revolver of the present invention is the employment of a transfer bar 24 having a flange portion 24a on one end thereof. The transfer bar 24 is adapted to be engaged by an embossment 25 on the trigger 18 when the trigger is pulled all the way back to thereby raise flange portion 24a between the hammer 19 and the rebounding firing pin 20. With the transfer bar 24 and associated flange 24a in the position shown in FIG. 1, the firing pin 20 cannot be actuated due to the recess 19a formed in the hammer 19. It is only when the flange 24a is moved upwardly in the hammer recess that the firing pin can be actuated.

To complete the structural description of the revolver of the present invention, a longitudinally extending operating rod 26 is mounted in the frame 1 and positioned below the barrel 3. One end of the rod is connected to an annular groove 3c formed in the barrel wall, and the opposite end of the rod is adapted to engage a cocking pin 28 and a roller 27 mounted on the hammer 19.

In the operation of the revolver of the present invention, when a cartridge is fired, the bullet enters the barrel 3, aligned with the lower chamber 2a of the cylinder; the thrust of the bullet and the exploding gas cause the barrel to slide forwardly as shown in phantom in FIG. 1. As the barrel 3 slides forwardly, the coil spring 4 is compressed until the forward movement of the barrel is arrested. During the sliding movement of the barrel, the rifled bore 3a imparts a rotational movement to the bullet which in turn imparts a rotational movement to the barrel. The slidable and rotatable movement imparted to the barrel 3, the compression of spring 4, together with the frictional resistance afforded by the washers 6 and 7, substantially absorb the initial shock and thrust imparted to the barrel, to thereby reduce the resultant recoil, whereby the revolver may be maintained on line of sight for subsequent firing.

After the thrust has been absorbed, the compression spring 4 expands, returning the barrel to the original position. During the reciprocatory movement of the barrel 3, the operating rod 26, being connected thereto, is also reciprocated so that on the return movement of the barrel 3 the rod 26 causes a cocking of the hammer 19 and automatic indexing of the cylinder 2, readying the revolver for single action operation. However, double action is never deactivated and can be utilized for the initial shot or reactivated for continuity in the event of a misfire, in lieu of thumb cocking.

The life of the rifled barrel 3 is enhanced since it is free to revolve; thus, wear is equally distributed 360 degrees around the barrel surface, while simultaneously imparting a rotation or spin to the projectile. Furthermore, there is a reduction of erosion, fouling, leading and stripping on the surface of the projectile.

Figure 2:
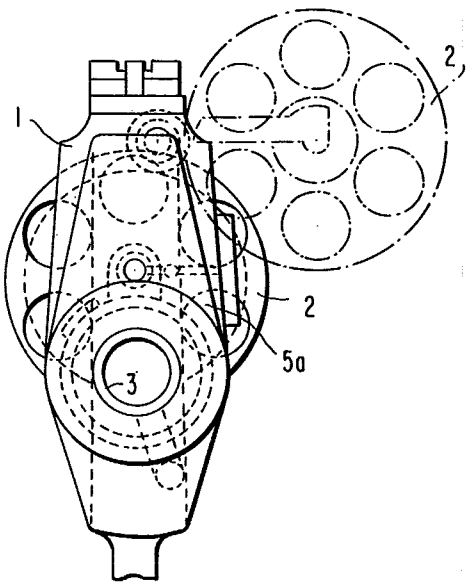
FIG. 2 is a front elevational view of the revolver showing, in phantom, the top pivotal swing-out cylinder in the open position.

When the cartridges are to be expended, the cylinder latch pin 15 is actuated allowing the torsion spring 11 to pivot the cylinder 2 outwardly as shown in phantom in FIG. 2. If, for any reason, the trigger 19 becomes cocked, the safety rod 21 will be in the elevated position in the recess 23 and will prevent the cylinder 2 from pivoting to the open position, or from returning to the closed position if the hammer becomes cocked during the reloading of the cylinder.

From the above description, it will readily become apparent to those skilled in the art that the construction and arrangement of the barrel 3, operating rod 26, safety rod 21, transfer bar 24, and spring operated crane assembly 8, results in a semi-automatic, double action service revolver having improved controllability, accuracy and safety.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a semi-automatic, double action revolver having a frame, a rotatable cylinder including a plurality of circumferentially disposed, axially extending chambers containing bullets, a trigger mechanism including a trigger and a hammer mechanism including a hammer and a firing pin, a cylinder latch including a latch pin, the improvement comprising, a barrel aligned with the lowermost chamber of the cylinder, said barrel having a rifled bore adapted to be engaged by a bullet when travelling therethrough, said barrel being slidably and rotatably mounted in said frame, spring means mounted between said frame and said barrel for biasing said barrel in a direction toward said cylinder, whereby upon firing the revolver the thrust of the bullet engaging the rifled bore causes the barrel to rotate and slide forwardly compressing the spring to thereby absorb the initial shock and thrust imparted to the barrel.

2. In a semi-automatic double action revolver according to claim 1, wherein friction washers are mounted within said frame, said barrel being slidably mounted within said friction washers.

3. In a semi-automatic double action revolver according to claim 2, wherein the spring means comprises a coil spring mounted coaxially with the barrel, said coil spring being biased between said friction washers.

4. In a semi-automatic double action revolver according to claim 1, wherein an operating rod is connected between the barrel and the hammer mechanism, whereby upon the return movement of the barrel the hammer becomes cocked.

5. In a semi-automatic double action revolver according to claim 1, wherein a safety rod is provided having one end connected to the trigger and the opposite end extending upwardly into a recess formed in the frame in proximity the end of the latch pin, whereby when the hammer is cocked the safety rod moves upwardly to a position adjacent the latch pin to prevent the cylinder from being moved to the open position.

6. In a semi-automatic double action revolver according to claim 1, wherein a recess is formed in the portion of the hammer adjacent the end of the firing pin, a transfer bar mounted in said frame, one end of said transfer bar having an upwardly extending flange, an abutment provided on said trigger, whereby when the trigger is pulled, the abutment engages the transfer bar causing the transfer bar flange to move upwardly between the hammer recess and the end of the firing pin, to thereby transmit the blow of the hammer to the firing pin via the transfer bar flange.

7. In a semi-automatic double action revolver having a frame, a rotatable cylinder, a cylinder latch, the improvement comprising, providing the cylinder with a top pivotal crane assembly comprising, a shaft having one end secured to the cylinder, the opposite end of said shaft being rotatably mounted in said frame, a torsion spring mounted in said frame, one end of said torsion spring being connected to said opposite end of said shaft, the opposite end of said torsion spring being connected to the frame, whereby upon release of the cylinder latch the torsion spring urges the cylinder to the open position.

8. In a semi-automatic double action revolver according to claim 7, wherein the shaft is rotatably mounted in an anti-friction bearing mounted in the frame.

* * * * *